US008133044B2

(12) United States Patent
Wiedenhoefer et al.

(10) Patent No.: US 8,133,044 B2
(45) Date of Patent: Mar. 13, 2012

(54) POSITIVE DISPLACEMENT CAPTURE DEVICE AND METHOD OF BALANCING POSITIVE DISPLACEMENT CAPTURE DEVICES

(75) Inventors: James Fredric Wiedenhoefer, Clifton Park, NY (US); Adam Rasheed, Glenville, NY (US)

(73) Assignee: General Electric Company, Niskayuna, NY (US)

( * ) Notice: Subject to any disclaimer, the term of this patent is extended or adjusted under 35 U.S.C. 154(b) by 861 days.

(21) Appl. No.: 12/040,161

(22) Filed: Feb. 29, 2008

(65) Prior Publication Data

US 2009/0220368 A1 Sep. 3, 2009

(51) Int. Cl.
*F03C 2/00* (2006.01)
*F03C 4/00* (2006.01)
*F04C 18/00* (2006.01)

(52) U.S. Cl. ..... 418/196; 418/48; 418/166; 418/197

(58) Field of Classification Search ..... 418/48, 418/68, 166, 168, 164, 195, 196, 197
See application file for complete search history.

(56) References Cited

U.S. PATENT DOCUMENTS 1,155,335 A * 10/1915 Bricknell ..... 418/9
1,892,217 A * 12/1932 Moineau ..... 418/48
2,085,115 A 6/1937 Moineau
2,615,436 A * 10/1952 Pawl ..... 123/241
2,733,854 A 2/1956 Chang
2,957,427 A 10/1960 O'Conner
3,168,049 A * 2/1965 Taylor et al. ..... 418/48
3,439,654 A * 4/1969 Campbell, Jr ..... 418/196
3,512,904 A 5/1970 Allen
4,029,443 A 6/1977 Burnside et al.
4,676,725 A 6/1987 Eppink
4,773,834 A 9/1988 Saruwatari
4,818,197 A 4/1989 Mueller
5,120,204 A 6/1992 Mathewson et al.
5,171,138 A 12/1992 Forrest
5,358,390 A 10/1994 Jager
5,722,820 A 3/1998 Wild et al.
5,779,460 A 7/1998 Marz
5,820,354 A 10/1998 Wild et al.
6,120,267 A 9/2000 Cunnignham
6,457,958 B1 10/2002 Dunn
6,655,344 B2 * 12/2003 Sager ..... 123/238
6,881,045 B2 4/2005 Zitka et al.
6,912,764 B2 7/2005 Amburgey

* cited by examiner

*Primary Examiner* — Theresa Trieu
(74) *Attorney, Agent, or Firm* — Richard A. DeCristofar

(57) ABSTRACT

A positive displacement capture apparatus contains a plurality of positive displacement capture devices which each contain a rotor portion positioned inside a casing portion to act as a least area rotor which captures a volume and moves the volume along the length of the separator. The rotor portion contains a plurality of lobes which interact with grooves in the casing portion, such that the interaction of the lobes and grooves create barriers which capture the volume. The creation of the volume creates a flow barrier between a downstream end of the separator and an upstream end of the separator. The flow separator is coupled to a combustion portion to provide a flow of material to the combustion portion. The plurality of positive displacement capture devices are positioned, oriented and rotational timed such that eccentric loads created by the rotation of the rotor portions cancel each other out during operation.

13 Claims, 9 Drawing Sheets

POSITIVE DISPLACEMENT CAPTURE DEVICE AND METHOD OF BALANCING POSITIVE DISPLACEMENT CAPTURE DEVICES

BACKGROUND OF THE INVENTION

This invention relates to positive displacement capture devices, and in particular to a method of balancing positive displacement capture devices for use with pulse detonation engines and other devices.

With the recent development of pulse detonation combustors (PDCs) and engines (PDEs), various efforts have been underway to use PDCs in practical applications, such as combustors for aircraft engines. However, there has been difficulty in incorporated PDCs and PDEs in practical applications because of the nature of the operation of pulse detonation devices. Namely, unlike the operation of normal gas turbine engines or Brayton cycle engines, in pulse detonation devices when the transition to detonation occurs a strong shock wave is created. Not only does this shock wave travel downstream, but it also travels upstream. The upstream travel of a shock wave can cause damage to upstream devices, such as compressors and fuel injection components, as well as temporarily stopping/reversing inlet air flow. All of these problems, as well as others, are to be avoided.

Various efforts have been attempted to address these problems, such as using mechanical flow control valves and fluidic valves. However, to date, these methods have been inadequate. For example, mechanical valves are required to have high frequency operation, which requires highly complex and costly structure. Further, high frequency valves create their own pressure waves, due to the rapid opening and closure of the valve. Further, although fluidic valves divert the backflow and shockwave against itself (thus reducing the strength of the back pressure wave), they can not completely prevent backflow.

Therefore, because of these difficulties, there exists a need to provide a device which is less complex than traditional mechanical valves, while providing 100% diodicity, to separate the upstream air and components from the combustion chamber of the pulse detonation device. Further, there is a need to provide such a device such that its loading impact on surrounding components is minimized.

SUMMARY OF THE INVENTION

In an embodiment of the invention, a positive displacement capture apparatus contains a positive displacement capture stage comprising a plurality of positive displacement flow devices, where each of the positive displacement flow devices contains a casing portion having a plurality of grooves formed on an inner surface of the casing portion, and a rotor portion having a plurality of lobes formed on an outer surface of the rotor portion, where the rotor portion is positioned adjacent to the inner surface of the casing portion such that the lobes interact with the grooves. The interaction of the lobes with the grooves creates a plurality of contact points between the lobes and grooves which travel around a perimeter of, and along a length of, the rotor portion as the rotor portion rotates about an axis relative to the casing portion, and the interaction captures a volume of material and moves the volume along a length of the device due to the relative rotation. Each of the plurality of positive displacement flow devices is positioned and oriented within the positive displacement capture stage such that a first group of structural loads created by the rotation of one of said rotor portions of one of the positive displacement flow devices is counteracted by a second group of structural loads created by the rotation of at least one other of the rotor portions of the at least one other of the positive displacement flow devices.

As used herein, a "pulse detonation combustor" PDC (also including PDEs) is understood to mean any device or system that produces both a pressure rise and velocity increase from a series of repeating detonations or quasi-detonations within the device. A "quasi-detonation" is a supersonic turbulent combustion process that produces a pressure rise and velocity increase higher than the pressure rise and velocity increase produced by a deflagration wave. Embodiments of PDCs (and PDEs) include a means of igniting a fuel/oxidizer mixture, for example a fuel/air mixture, and a detonation chamber, in which pressure wave fronts initiated by the ignition process coalesce to produce a detonation wave. Each detonation or quasi-detonation is initiated either by external ignition, such as spark discharge or laser pulse, or by gas dynamic processes, such as shock focusing, auto ignition or by another detonation (i.e. cross-fire).

BRIEF DESCRIPTION OF THE DRAWINGS

The advantages, nature and various additional features of the invention will appear more fully upon consideration of the illustrative embodiment of the invention which is schematically set forth in the figures, in which.

DETAILED DESCRIPTION OF THE INVENTION

The present invention will be explained in further detail by making reference to the accompanying drawings, which do not limit the scope of the invention in any way.

Figure 1:
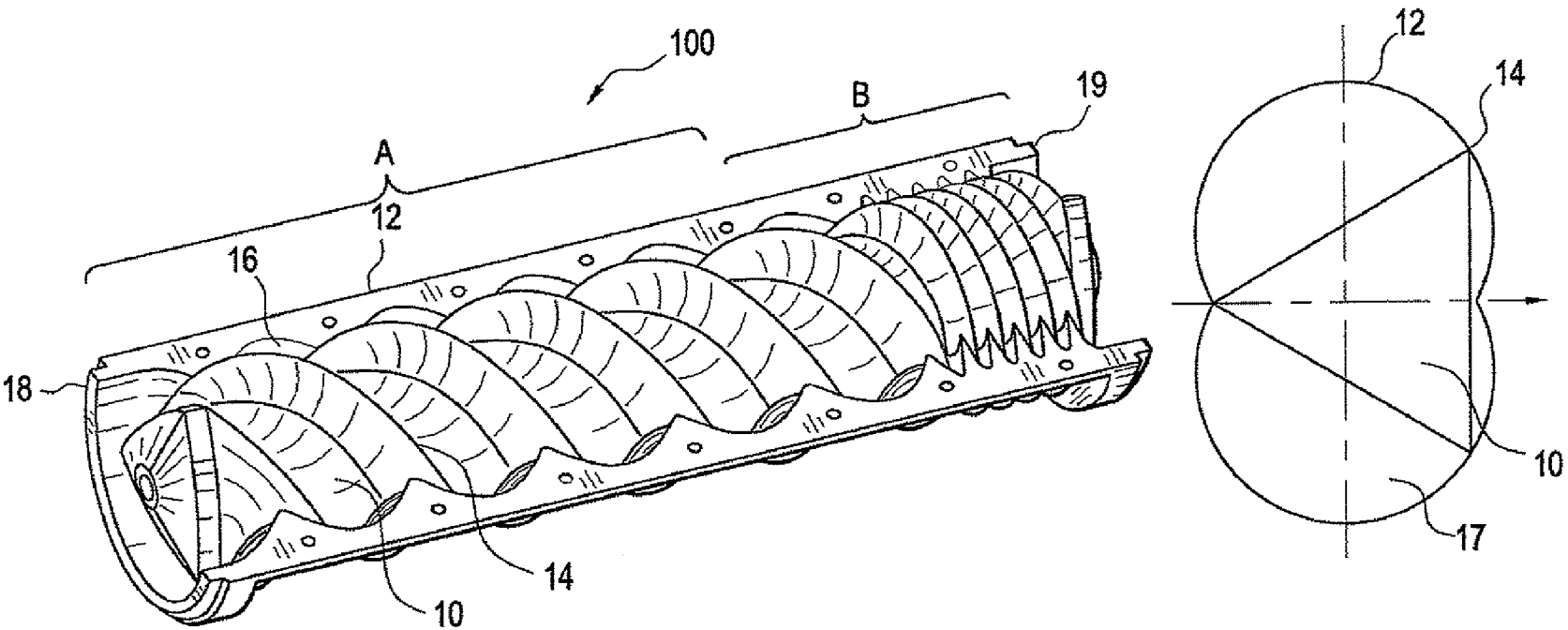
FIG. 1 is a diagrammatical representation of a positive displacement flow separator in accordance with an exemplary embodiment of the present invention.

FIG. 1 depicts a diagrammatical representation of an exemplary embodiment of the positive displacement capture device 100 of the present invention. In the context of the present application, the term "flow separator" and "capture device" will be used interchangeable, and are not intended to affect the scope of the present invention. The device 100 provides a continuous positive flow rate from an upstream end to the downstream end, with minimal pressure loss. The device 100 contains a rotor portion 10, which rotates inside a casing portion 12. Together, the rotor portion 10 and the casing portion 12 acts as a least area rotor which closes off a volume so as to provide 100% flow blockage from a downstream end 19 of the device 100 to an upstream end 18 of the device 100. For the purposes of this application a "least area rotor" is a first geometric shape (e.g. a rotor), which is enscribed by a second geometric shape (e.g. a casing) in such a way that the rotor has one contact point with every side or face of the casing regardless of orientation of the rotor as either one or both of the shapes rotate about an axis. A common example of a least area rotor includes, but is not limited to a Reuleaux triangle.

The rotor portion 10 has a plurality of lobes 14 which are continuous along the length of the rotor portion 10. The lobes 14 ride in continuous grooves 16 which are in the inner surface of the casing portion 12. The interaction of the lobes 14 of rotor 10 and the lobes of the casing 12 create a barrier between the upstream portion 18 and downstream portion 19 which move down the length of the device 100 as the rotor portion 10 and/or the casing portion 12 are turned. Basically, the interaction between the lobes 14 and the grooves 16 create barriers (which can also be described as contact points, regardless of whether physical contact is made or not) that move along the length of the device 100 based on the pitch and rotational speed of the components.

Because the rotor portion has a triangular cross-section, there are three lobes 14 in the embodiment shown in FIG. 1. In the embodiment shown in FIG. 1, there are two grooves 16 in the casing portion 12. However, the present invention is not limited to this embodiment. As will be discussed in more detail below, the number of lobes/grooves will vary depending on the configuration employed. For example, in a further embodiment of the present invention there are more grooves 16 then there are lobes 14. As indicated above, in the embodiment shown in FIG. 1, there is one less groove 16 than lobe 14. However, the present invention is not limited in this regard. The combination of the rotor portion 10 and the casing portion form a least area rotor.

Further, in the embodiment shown in FIG. 1, there are three lobes 14 on the rotor 10 and one fewer groove 16 on the casing 12. In this configuration, the casing 12 rotates faster than the rotor 10 (in the embodiment where both components rotate). However, it is also contemplated that the casing 12 may have one more groove 16 than lobes 14 of the rotor 12, and in such an embodiment the rotor 10 rotates faster than the casing 12.

Because the overall operation of the invention is similar to that of a least area rotor, each lobe 14 makes contact with all sides of the casing portion 12 (via the grooves 16) regardless of the orientation or angle of rotation of the rotor portion 10 within the casing portion 12. An example of this type of mathematical geometry is known as a Reuleaux Triangle, which is known to those of ordinary skill in the art. Of course, it is noted that the present invention is not limited to the application of this geometry, but it is referenced merely as an example. To attain the least area rotor performance of the present invention, the number of contact points between rotor portion 10 (via the lobes 14) and the casing portion 12 (via the grooves 16) is N+1, where N is the number of lobes 14 on the rotor portion 10. Further, regardless of the orientation of the rotor portion 10 the number of contact points for any one lobe 14 will be N+1, with N being the number of lobes 14 present on the rotor portion. Therefore, in the embodiment shown in FIG. 1 there are four (4) contact points as there are three (3) lobes 14.

Further, as shown, in the exemplary embodiment, the geometry of each of the rotor portion 10 and the casing portion 12 are swept along a helical axis. However, each of the rotor portion 10 and the casing portion 12 are swept at a different pitch. Because of this, the present invention "captures" a volume (which may include air, gases, fluids or solids) between the barriers formed by the interaction of the rotor lobes and casing grooves, and moves the volume downstream along the length of the device 100 until the volume opens at the downstream portion 19 of the device 100. However, because of the geometries of the rotor portion 10 and the casing portion 12, the downstream portion 19 of the device 100 is closed off from the upstream portion 18 of the device 100, so that any pressures or backflows from any downstream component is blocked from any upstream components. It is these barriers (i.e. contact points) which form the boundaries of the captured volume, as such as the barriers (i.e. contact points) move along the device 100 the captured volume moves along as well.

In an embodiment of the invention, the ratio of the pitch of the rotor portion 10 to the casing portion 12 is proportional to the number of grooves 16 on the casing to the number of lobes 14 on the rotor. It is this difference in pitch which causes the grooves 14 and lobes 16 to interact with each other to form periodic barriers, which are moved along the axis of the device 100.

Further, the geometries of the rotor portion 10 and the casing portion 12 are such that a cross-sectional area 17 is created between the two along the entire length of the device 100. This area 17 has a different angular position along a length of the device 100, and is used to create the volume.

Thus the present invention is ideal for applications where it is desirable to provide a flow of material (gas, liquid or solid) at a constant rate and protect upstream components from any downstream events or forces. For example, the present invention may be used as a flow device for a pulse detonation engine or combustor. It is known that the detonations created in pulse detonation engines/combustors create high pressure shock waves which tend to propagate upstream and can damage upstream components, or stall engine or compressor inlets. Therefore, it is desirable to block upstream components from this high pressure shock wave. The present invention accomplishes this by using the "least area rotor geometry" described herein. Of course, the present invention is not limited to this application, but can be used in many applications where the advantages of the present invention are desired.

In the present invention, the number of rotations needed to capture the volume depends on the ratio of lobes 14 on the rotor portion 10 to the grooves 16 on the casing portion 12 and the relative rotation angle between them. This will be discussed in more detail below. Further, the flow rate of the device 100 is a function of the rotational speed of the rotor portion 10 and casing portion 12. One of the advantages of the present invention, is that the flow rate of the device 100 is not affected by the back pressure from any downstream device. Because the upstream portion 18 of the device 100 is completely isolated, and the volume is delivered to the downstream portion 19 via the rotation, the flow rate is not affected or reduced by downstream back pressure. Instead, the flow rate (or flow volume) is a function of factors such as rotational speeds and geometry of the rotor and casing portions.

In one embodiment of the present invention, both the rotor portion 10 and the casing portion 12 rotate. They rotate in the same direction as each other, but they rotate at different speeds. This will be explained in more detail below. In an embodiment such as this, because of the rotation of the casing portion 12, the rotor portion 10 can rotate about its central axis. In another exemplary embodiment, the casing portion 12 is stationary and only the rotor portion 10 rotates. However, in this embodiment, not only does the rotor portion 10 rotate, but it also precesses about a central axis. This precession and rotation are needed to ensure the device acts as a least area rotor to capture a volume and provide 100% diodicity between the downstream portion 19 and the upstream portion 18.

In an embodiment of the invention, the geometries of the rotor portion 10 and the casing portion 12 are such that no physical contact occurs between the lobes 14 and the grooves 16. This greatly reduces the amount of wear and friction caused by the relative rotations of the rotor portion 10 and the casing portion 12. With that said, the spacing between the tips of the lobes 14 and the deepest portions of the grooves 16 is to be such that flow is "choked." Stated differently, the spacing is such that the resistance to the captured material (i.e. air, gas, liquid, or solid) flowing from one trapped volume to an adjacent volume is maximized. The spacing is to be minimal so as to inhibit any flow from passing between the lobes 14 and grooves 16, at their closest points. Of course, it is understood that the size of the gaps between the tips of the lobes and grooves 16 is a function of the medium being conveyed and the pressures involved. For example, the size of the gaps would be smaller for when the medium is a gas (for example an engine oxidizer) than for a liquid or a solid (for example coal). Any known end or tip configuration or structure for the lobes 14 and/or grooves 16 may be used to minimize flow-through (maximize choke). The structure used is to have the ability to effectively seal and isolate the trapped volume within the device. In an alternative embodiment, contact is made between the lobes 14 and the grooves 16 to provide the barrier. In this embodiment a contact seal is made which captures the volume.

Further, in an exemplary embodiment of the present invention, the length and overall dimensions of the device 100 is to be determined based on the operational and performance criteria of the specific application. Further, the present invention contemplates that more than one volume can be trapped by the rotor portion 10 and casing portion 12. The number of volumes trapped (or isolated) at any given time is a function of the length of the device 100 and the pitch/geometry of the helical lobes 14 and grooves 16. In the present invention, the flow rate of the device 100 is a function of the helical pitch angle of the rotors and the rotational speed of the components.

In an embodiment of the present invention, the cross-sectional geometry and the pitch of the rotor 10 and casing 12 are constant throughout the length of the device 100. In such a configuration, the present invention acts essentially as a pump or a valve, providing a desired flow rate from the upstream portion 18 to the downstream portion 19 of the device. This is essentially shown in the section A of the device 100, in FIG. 1. Because of the nature of the device 100, in such a configuration, the device 100 can consistently pump from a lower pressure to a higher pressure (on the downstream portion 19) without exposing any upstream components to the higher downstream pressure or pressure spikes or transients.

In a further embodiment of the present invention, as shown in FIG. 1, the device 100 contains a reduced pitch portion B. The reduced pitch portion B is downstream of the upstream flow portion A, whereas the grooves 16 and lobes 14 are continuous from the upstream flow portion A, but have a decreased pitch. Because of the decreased pitch, the speed with which the barriers travel down the device 100 decreases, allowing the upstream barriers to "catch up." Thus, the isolated volume is compressed. The degree of pitch in the reduced pitch portion B dictates the volumetric compression ratio, and thus the level of compression achieved for the isolated volume.

Thus, in the above described embodiment, compression occurs at the transition between the upstream flow portion A and the reduced pitch portion B, as the upstream barriers "catch up" with the downstream barriers which have entered the reduced pitch portion B. By having the barriers "catch up" with each other the trapped volume is reduced, resulting in compression of the material trapped in the volume.

In an alternative embodiment, the device 100 can compress the volume in the compression portion B by changing the cross section of the rotor portion 10 and/or casing portion 12. This will be discussed in more detail below.

In a further embodiment of the present invention, not shown, the device 100 contains a downstream portion with an increased pitch (i.e. replacing the reduced pitch portion B). The overall configuration is similar except that the increased pitch portion is downstream of the upstream flow portion A, whereas the grooves 16 and lobes 14 are continuous from the upstream flow portion A, but have an increased pitch. Because of the increased pitch, the speed with which the barriers travel down the device increases, allowing the downstream barriers to move ahead faster. Thus, the isolated volume is expanded. The degree of pitch in the increased pitch portion dictates the volumetric expansion ratio, and thus the level of expansion achieved for the isolated volume.

In the present invention, various variables can be used/adjusted to achieve the desired performance of the device 100. For example, a larger pitch angle of the lobes/grooves will result in overall thinner lobe 14 structure, and thus provides weight savings, but a potentially weaker lobe. However, a larger pitch angle provides a relatively low volumetric flow rate, whereas a smaller pitch angle will create thicker, stronger lobes and provide a higher volumetric flow rate, but will provide more weight because the device 100 will be longer.

Further, in the present invention, as the number of lobes 14 increase, the number of volumes or chambers that are created in a given length of the device 100 are increased. Thus, the overall frequency of the device 100 is increased (i.e. more volumes being opened to the downstream portion 19 during a give time period). As such, a higher number of lobes provide a smoother flow.

Further, in the embodiment of the present invention, in which both the rotor portion 10 and casing portion 12 are rotated (so as to have the rotor portion 10 rotate along a fixed axis) the number of lobes 14 used will affect the relative rotational velocity of the rotor portion 10 and the casing portion 12. As indicated above, the casing portion 12 rotates at a different speed than that of the rotor portion 10 in those embodiments where both components rotate. Their relative rotational velocities are a function of the number of lobes 14 on the rotor portion 10, and the number of grooves 16 on the casing 12.

In the exemplary embodiment of the present invention shown in FIG. 1, where the number of lobes 14 is higher than the grooves 16 (i.e. three lobes 14 to 2 grooves 16), the casing portion 12 rotates at a higher rate than the rotor portion 10, and as indicated above the relative rate between the components is a function of the number of lobes 14. Thus, the relative rotational rate is a function of the number of lobes 14 on the rotor 10 and the number of grooves 16 in the casing 12, where the number of grooves 16 is expressed relative to the number of lobes 14. Stated differently, when N is the number of lobes 14, then an expression of N−1 or N+1 will correspond to the number of grooves 16. For example, in the embodiment shown in FIG. 1 there are N−1 grooves 16 (i.e. one less groove 16 than lobe 14). Therefore, in this embodiment the ratio of rotational speed between the casing 12 and the rotor 10 is N/(N−1). Likewise, if the casing 12 has one more groove 16 than lobe 14 on the rotor the ratio of rotational speed of the casing 12 to the rotor will be N/(N+1).

As indicated above, the configuration of the device 100 shown in FIG. 1 is one where the number of lobes 14 is more than the number of grooves 16. However, the present invention is not limited in this regard as further least area rotor geometries may be employed. This is shown for example in FIGS. 2 and 3, where the number of grooves is more than the number of lobes. In configurations such as these the rotor portion rotates at a speed which is faster than the outer portion. This relative rotational speed ensures that a least area rotor geometry and functionality is maintained. In these embodiments, the relative rotational speed of the casing portion to the rotor portion is defined by the expression N/(N+1), where N is the number of lobes on the rotor portion.

Figure 2:
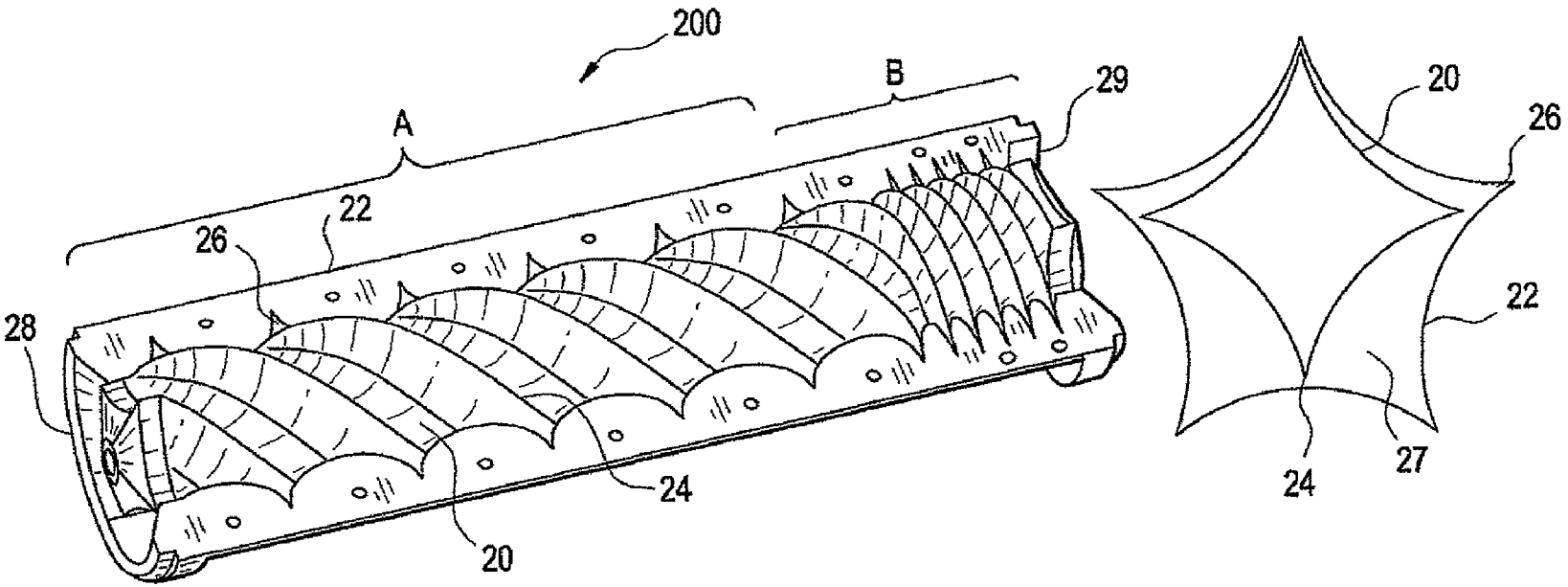
FIG. 2 is a diagrammatical representation of a positive displacement flow separator in accordance with another exemplary embodiment of the present invention.

FIG. 2 depicts a device 200 of the present invention which has a configuration where there are four (4) lobes 24 on the rotor portion 20 and five (5) grooves 26 in the casing portion 22. As with the above described embodiment, one embodiment of this type can have both the rotor portion 20 and the casing portion 22 rotating, while another embodiment has only the rotor portion 20 rotating (and thus precessing also). In the embodiment, where both the rotor and casing portions rotate, the casing portion 22 rotates at a slower speed than the rotor portion 20.

In an embodiment, the rotor and casing portions may be configured such that they rotate and precess through either a hypocycloidic or epicycloidic geometry path. Both of these geometries and the mathematical expressions therefore are known by those of ordinary skill in the industry. Therefore, a detailed discussion of these geometries will not be included herein. Thus, in embodiments of the present invention, the relative motion of the rotor portion 20 within the casing portion is either hypocycloidic or epicycloidic. The geometry chosen is a function of the operation parameters and desired performance criteria, and the present invention is not limited in this regard. Of course, it is also contemplated that additional geometries, such as a Reuleaux triangle geometry may be used, as long as the geometry results in the creation of a least area triangle which captures a volume and progress the volume along the length of the device 200. Those of ordinary skill will recognize that other cross-sectional geometries may be employed for the present invention, and that a computer program may be used to numerically generate a cross-sectional profile which operates in a similar manner as that discussed above.

The hypocycloid geometry is that of a curve formed by a fixed point P on the circumference of a small circle having a radius b which is rolled around the inside of a larger circle with a radius a, where a>b. In an embodiment of the present invention, a set of hypocycloid curves are used where a/b=n, where n is an integer number and n>2. The Cartesian coordinates of the point P are defined by the following equations:

$$x = (a-b)\cos\phi + b\cos\left(\frac{a-b}{b}\phi\right)$$

$$y = (a-b)\sin\phi - b\sin\left(\frac{a-b}{b}\phi\right)$$

Figure 7A:
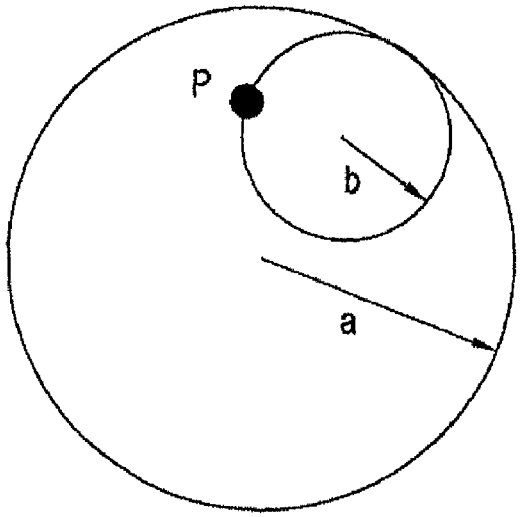
FIG. 7*a* is a geometrical representation of how a hypocycloid shape would be created.
Figure 7B:
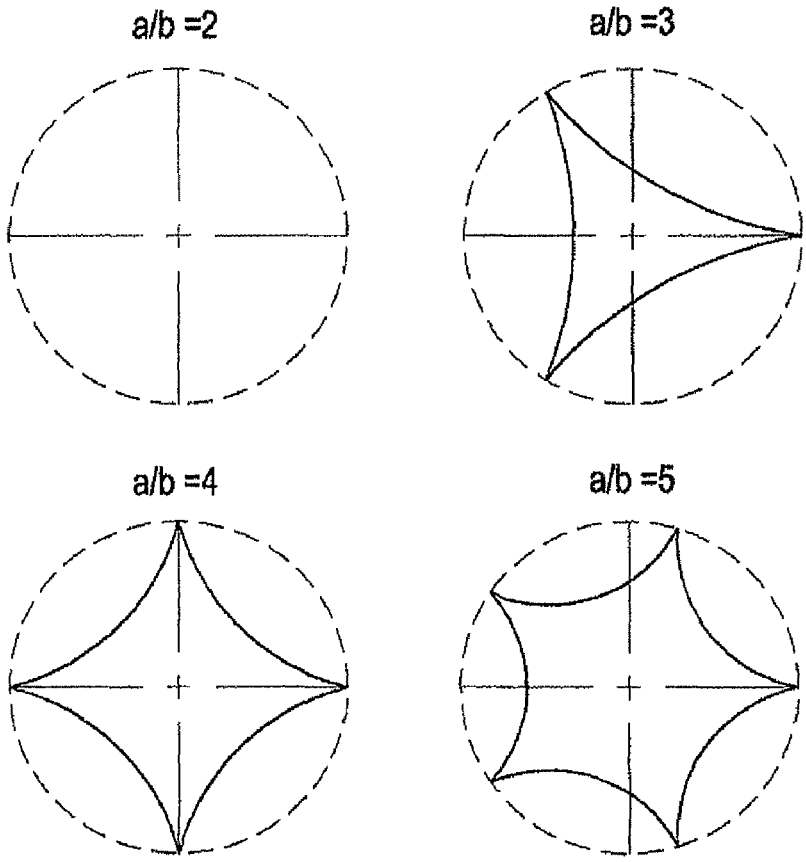
FIG. 7*b* is a geometrical representation of various hypocycloid curves generated with various integer ratios of a/b.

A geometric representation of how to construct a hypocycloid geometry is shown in FIG. 7*a*. Further, FIG, 7*b* shows several hypocycloid curves generated using various values for n=a/b. With a hypocycloid configuration, the offset of the rotor portion is a function of the number of lobes on the rotor portion and the radius a. The offset is defined by the ratio a/N, where N is the number of lobes. Therefore, for example, the offset ratio for the rotor portion 20, in FIG. 2 is defined by a/4 to ensure that the device 200 acts as a least area rotor.

The epicycloid geometry is that of a curve formed by a fixed point P on the circumference of a small circle having a radius b which is rolled around the outside of a larger circle with a radius a, where a>b. In an embodiment of the present invention, a set of epicycloid curves are used where a/b=n, where n is an integer number and n>2. The Cartesian coordinates of the point P are defined by the following equations:

$$x = (a+b)\cos\phi - b\cos\left(\frac{a+b}{b}\phi\right)$$

$$y = (a+b)\sin\phi - b\sin\left(\frac{a+b}{b}\phi\right)$$

Figure 8A:
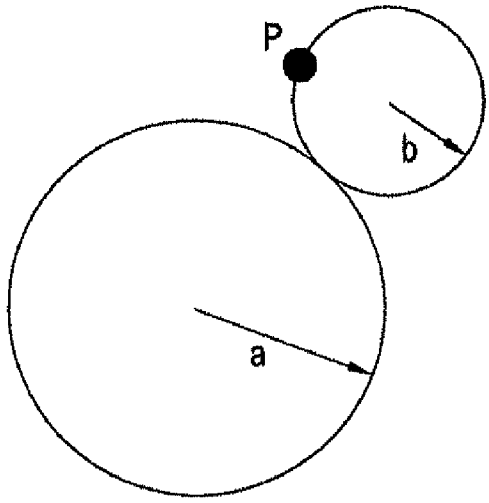
FIG. 8*a* is a geometrical representation of how a epicycloids shape would be created.
Figure 8B:
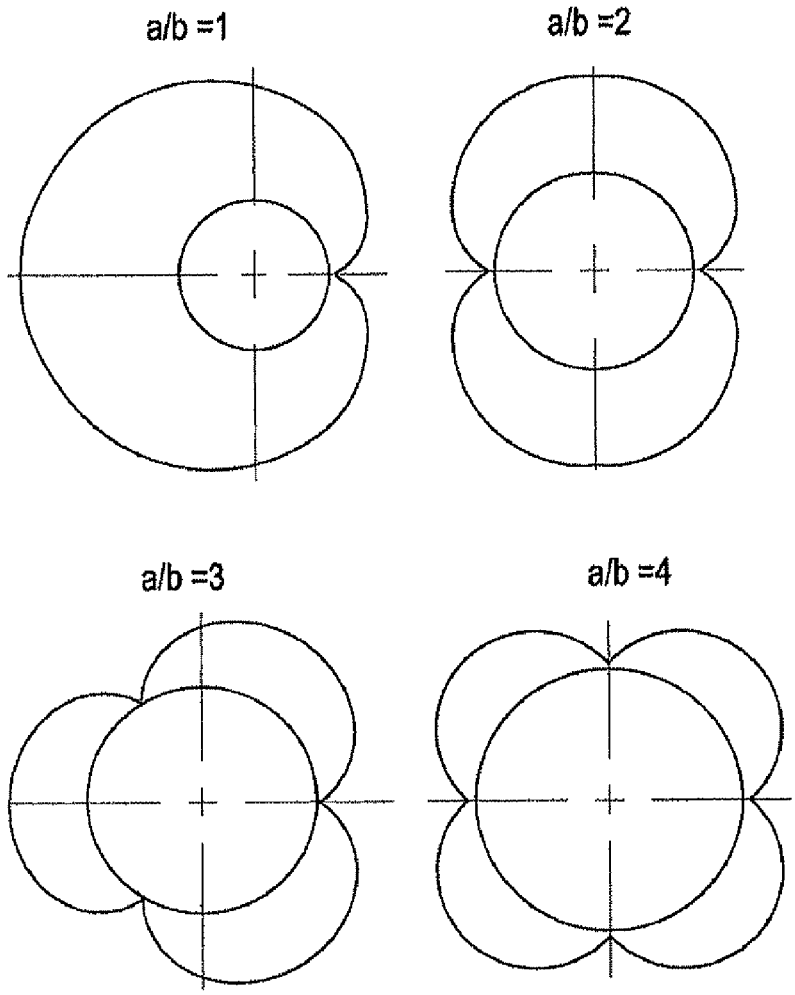
FIG. 8*b* is a geometrical representation of various epicycloids curves generated with various integer ratios of a/b.

A geometric representation of how to construct an epicycloid geometry is shown in FIG. 8*a*. Further, FIG. 8*b* shows several epicycloid curves generated using various values for n=a/b. With an epicycloid configuration, the offset of the rotor portion is a function of the number of lobes on the rotor portion and the radius a. The offset is defined by the ratio a/N, where N is the number of lobes. Therefore, for example, the offset ratio for the rotor portion 10, in FIG. 1 is defined by a/3 to ensure that the device 100 acts as a least area rotor.

In the embodiment shown in FIG. 2, the cross-sectional geometry of the rotor portion 20 and the casing portion 22 utilizes a hypocycloidic pattern. This rotational configuration allows for the creation of the least area rotor geometry resulting in trapping a volume for transmission from an upstream end 28 to a downstream end 29. As with the embodiment shown in FIG. 1, this embodiment of the invention has an upstream flow portion A, which effectively acts as a pump. The reduced pitch section B allows the upstream barriers to catch up, thus compressing the volume before expelling to the downstream portion 29. Of course, the embodiment is not limited to this and only a flow portion A may be used.

Additionally, an area 27 is created between the rotor portion 20 and the easing portion 22. The area 27, when summed along a length of the device 200, creates the volume.

Figure 3:
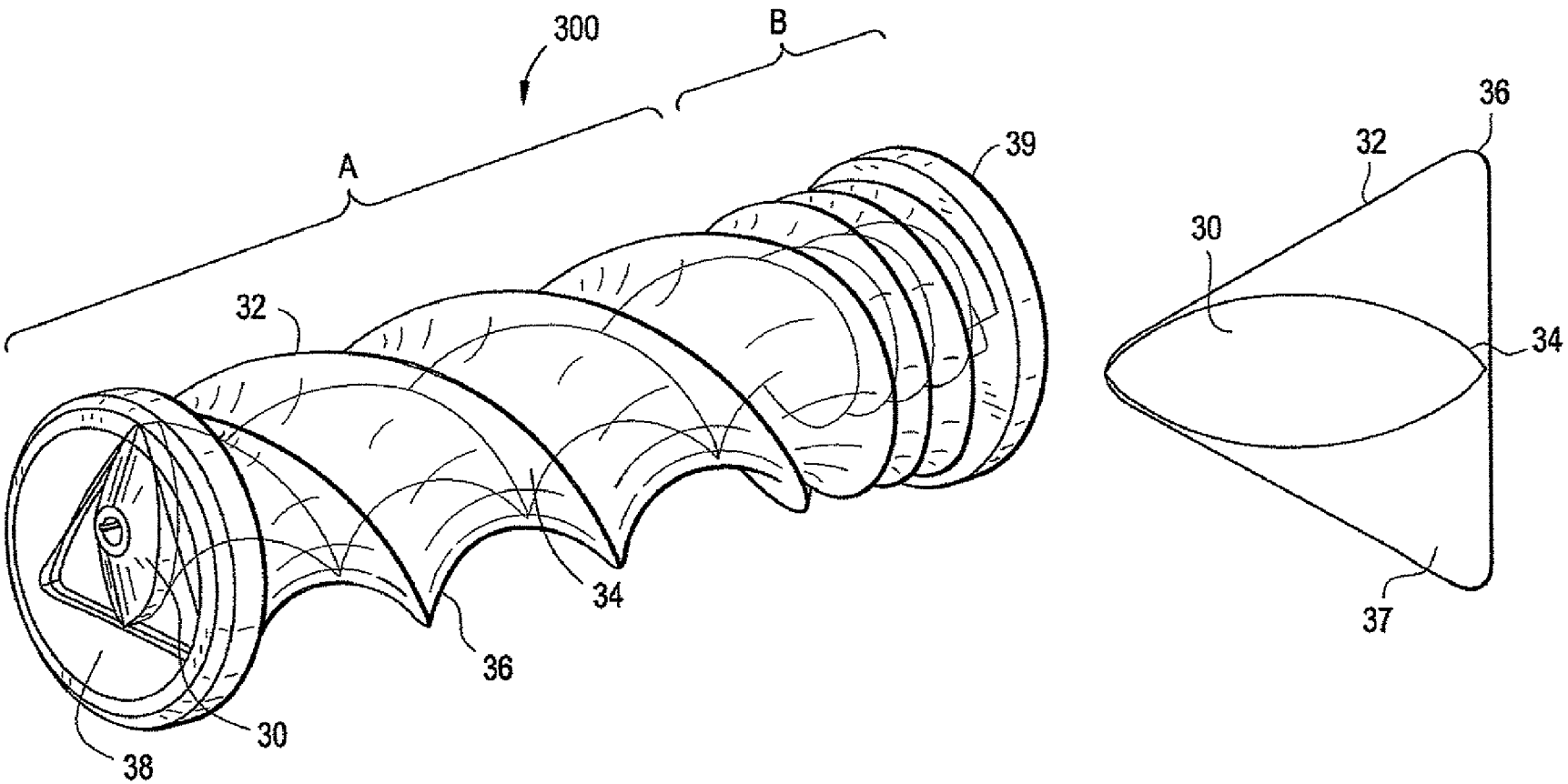
FIG. 3 is a diagrammatical representation of a positive displacement flow separator in accordance with a further exemplary embodiment of the present invention.

Similarly, FIG. 3 discloses a flow control device 300 having a rotor portion 30 and a casing portion 32, where the rotor portion 30 is shaped like a lens having two (2) lobes 34 and the casing portion 32 has three (3) grooves 36. Again, a flow enters the upstream end 38 and a volume is captured and moved so as to exit the downstream end 39. Further, the device 300 is shown with an upstream flow portion A and a reduced pitch portion B. Additionally, as with the previously discussed embodiments, an area 37 is created between the rotor portion 30 and the casing portion 32.

As with the embodiment in FIG. 2, in the embodiment shown in FIG. 3, if both the casing portion 32 and the rotor portion 30 are rotated, then the casing portion 32 rotates at a speed slower than the rotor portion 30. Additionally, to capture a volume in this embodiment, the rotor portion 30 makes contact at three (N+1) points on the casing portion 32.

In an embodiment of the invention, the pitch ratio between the lobes of the rotor portion and the grooves of the casing portion are controlled so that the device acts as a least area rotor at all points along the axis of the device. The pitch ratio of the casing 32 to the rotor 30 is a function of the number of lobes and grooves and is defined by the ratio N/G, where N is the number of lobes and G is the number of grooves. For example, the pitch ratio of the embodiment shown in FIG. 1 is 1.5 (i.e. 3/2), thus the pitch of the lobes 14 needs to be 1.5 times greater than then the pitch of the grooves 16. In the FIG. 2 embodiment, the pitch ratio is 0.8 (i.e. 4/5), and thus the pitch of the lobes 24 should be 80% of the pitch of the grooves 26. As a final example, the pitch ratio of the FIG. 3 embodiment is 0.67 (i.e. 2/3), and thus the pitch of the lobes 34 are to be 67% of the pitch of the grooves 36.

Of course it is understood that for the purposes of the present invention, any lobe/groove ratio can be used as long as the overall cross-sectional geometry results in the creation of a least area rotor which allows for the capture of a volume and isolation of the upstream end of the flow device from the downstream end. In general, it is contemplated that embodiments of the present invention (in addition to those shown in FIGS. 1 to 3) have lobe to groove ratios of N/(N−1) and N/(N+1) where the actual number of lobes is dependant on the overall size and intended application of the device.

However, it is noted that in embodiments of the present invention, where the lobe/groove ratio is over 1, the geometries are such that more turns of the rotor portion are required before of a volume is captured (i.e. completely closed). For example, in the embodiment shown in FIG. 1 (having a ratio of 3/2) it is necessary for the casing portion to make 2.5 revolutions before a volume is captured. However, in the embodiment shown in FIG. 2 only one (1) revolution of the outer casing 22 is required for a volume to be captured. Depending on the operational and design parameters, either of these may be desirable, however, from a pure efficiency stand point the embodiment shown in FIG. 2 would be more efficient than that of FIG. 1 as only a single revolution is required to capture the volume. Further, because of this relationship, the length of the embodiment shown in FIG. 1 will be 2.5 times longer than the embodiment shown in FIG. 2 to capture a volume.

The total number of contact points of the N/(N−1) configurations, such as the embodiment shown in FIG. 1, is the sum of the number of lobes 14 of both rotor 10 and the grooves 16 of the casing 12 (i.e. 2N−1). Also the number of turns of the casing 12 to capture a volume is 2+1/(N−1), where N is the number of lobes 14 on the rotor 10. The situation is different for the N/(N+1) embodiment shown in FIG. 2, however. For these configurations, the total number of contact points is (N+1) and the minimum number of turns of the outer casing to capture a volume is equal to 1. Exemplary embodiments are shown in the Table below:

| Lobe/Groove | Contact Points | Chamber Cycle |
|---|---|---|
| 3/2 | 5 | 2.5 |
| 4/3 | 7 | 2.33 |
| 5/4 | 9 | 2.25 |
| 3/4 | 4 | 1 |
| 4/5 | 5 | 1 |

The number of revolutions required by the casing portion required to capture a volume is referred to as the chamber cycle in the table above.

Finally, using the above information, the inner rotor offset (needed for the least area rotor geometry) can be determined. Specifically, the inner rotor offset is a function of the number of lobes and the radius "a" of the rotor portion (i.e. similar to the diameter "a" in the above discussion of the epicycloid and hypocycloid geometries). Namely, the inner rotor offset is defined by the relationship a/N, where N is the number of lobes.

The present invention is not limited to the above discussed embodiments, as it is contemplated that additional geometries may be used, as long as the employed geometries effectively form a least area rotor configuration so that a volume is captured and moved longitudinally along the device.

Figure 4B:
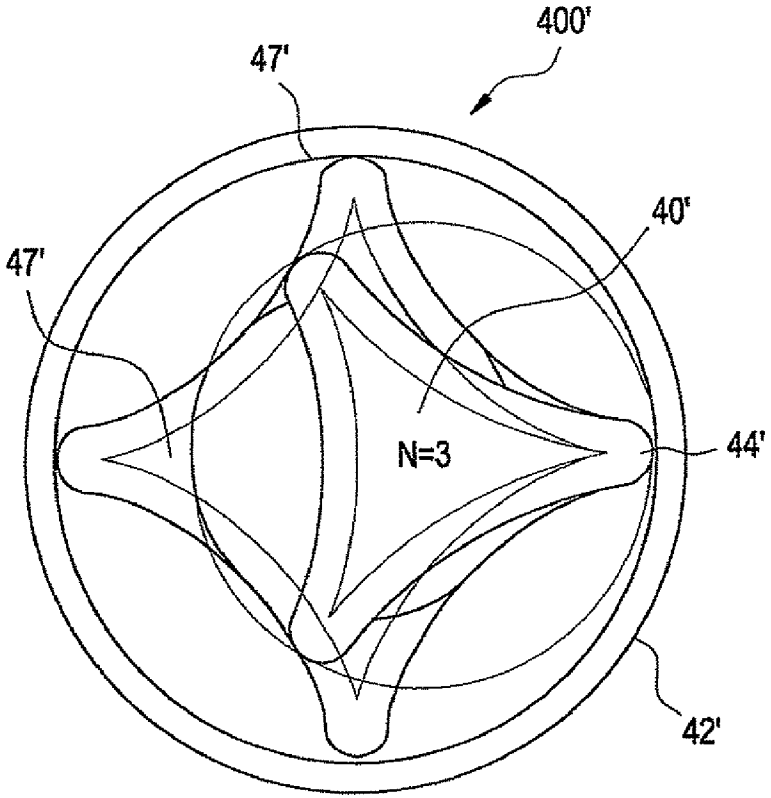
FIGS. 4A and 4B are diagrammatical representations of alternative cross-sections of an exemplary embodiment of the present invention.
Figure 4A:
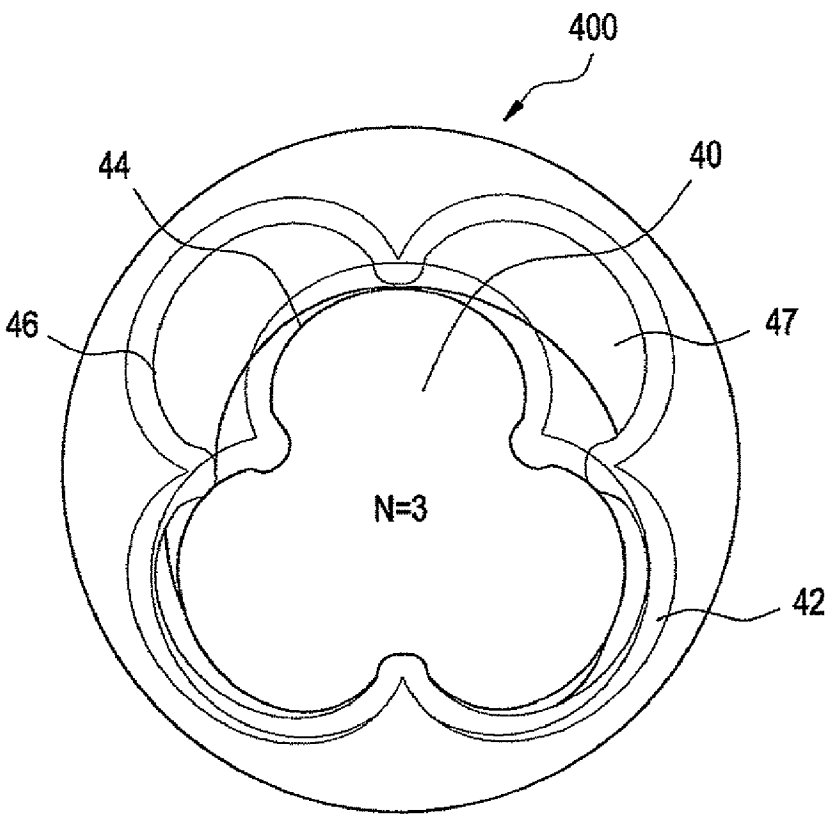

FIGS. 4A and 4B depict cross-sections of additional alternative embodiments of the present invention. In each figure, the cross-section of a positive flow control device 400, 400' is shown. Each embodiment has a casing portion 42, 42' and a rotor portion 40, 40' positioned therein. Each of the rotor portions 40, 40' have three (3) lobes 44, 44', while each of the respective casing portions 42, 42' have four (4) grooves 46, 46'. Accordingly, in each embodiment, if the casing portion 42, 42' is rotated, its rotational speed is less than that of the rotor portion 40, 40'.

Further, as shown in each of the respective figures, an area 47, 47' is created. In FIG. 4A the area 47 is smaller than that in FIG. 4B, thus the FIG. 4A embodiment captures a smaller volume, but because of the thickness of the lobes may provide additional durability, whereas the embodiment in FIG. 4B captures more volume, but may provide less durability.

Further, the embodiment shown in FIG. 4A uses a epicycloid base geometry for its rotation and precession, whereas the FIG. 4B embodiment uses a hypocycloid base geometry. The profile geometry of the embodiments shown in FIGS. 4A and 4B was generated by numerically creating a curve which was equidistant from the base geometry curve at all points. For the epicycloid based geometry, shown in FIG. 4A, the offset curve was generated inside the base geometry. For the hypocycloid based geometry, shown in FIG. 4B, the offset curve was generated outside the base geometry. For the purposes of the present invention, the actual amount of offset used is based on operational and design parameters of the device. Further, the amount of offset can be different, or change, along the length of the device.

By allowing the offset to change along the length of the device the thickness of the lobes can be increased in regions requiring greater strength. Further, changing the offset distance changes the cross sectional area, thus providing either compression or expansion independent of the rotor pitch. In an embodiment employing this feature the change in the cross-sectional area effectively causes compression or expansion of the captured volume similar to that described above. Therefore, compression or expansion can be achieved without changing rotor pitch. In an additional embodiment, the offset distances can be used to ensure that the tips of the lobes become rounded (similar to that shown in FIG. 4A, which are more durable, easier to manufacture, create greater flow resistance, thus increasing the sealing capacity of the device. Of course, it is contemplated that the offset distance can be selected to accommodate any desired operational or design characteristics and may allow for the lobes to be made having a relatively pointed end.

Figure 5:
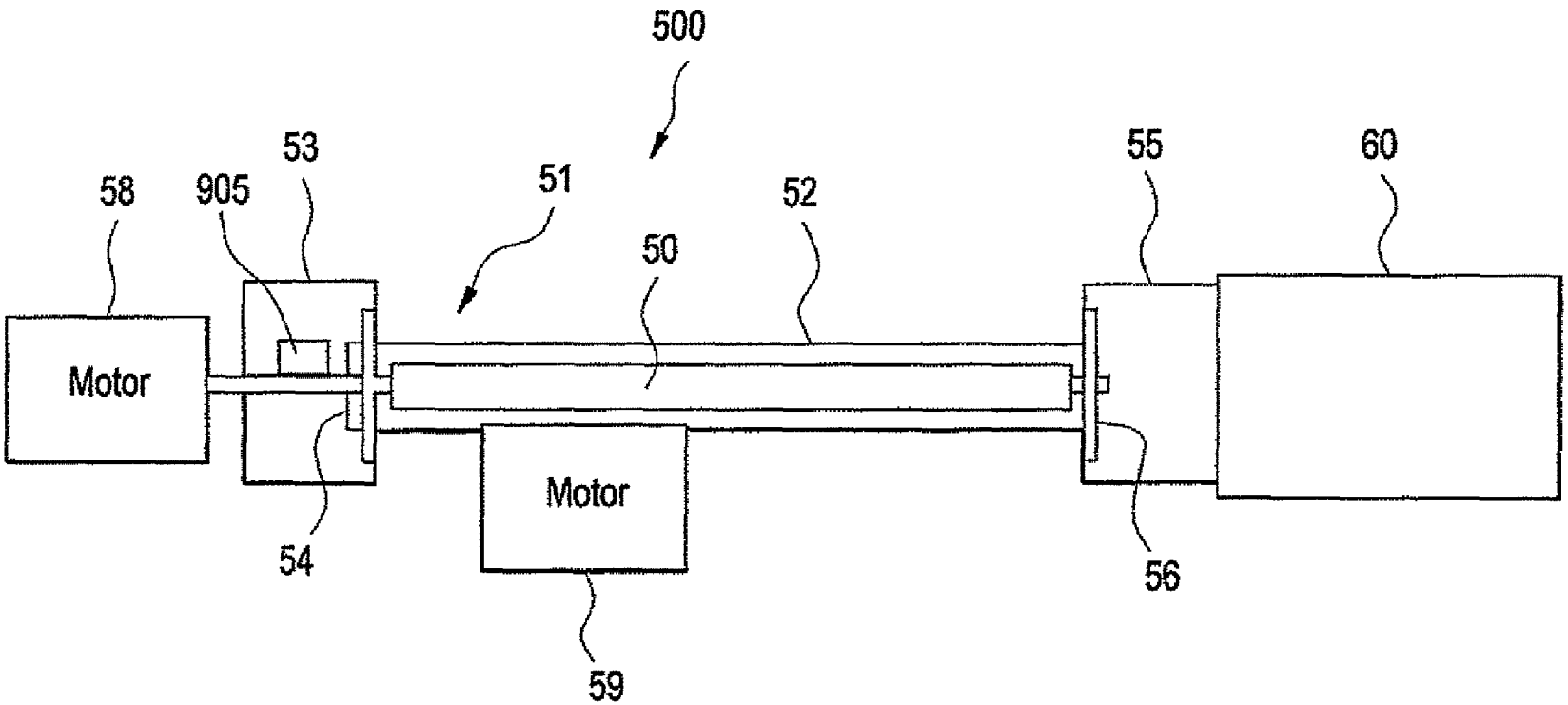
FIG. 5 is a diagrammatical representation of a system incorporating an exemplary embodiment of the present invention.

FIG. 5 depicts a device 500 employing an embodiment of the present invention. Specifically, the device 500 includes a positive flow control device 51 which contains a rotor portion 50 and a casing portion 51, having an upstream end 54 and a downstream end 56. The detailed configuration of the flow control device 51 can be that of any of the above discussed types, or similar embodiments. As shown in FIG. 5, the rotor portion 50 is driven by motor 58, whereas the casing portion is driven by motor 59. Alternatively, one motor may be used where the rotor 50 and casing 51 are coupled together via a set of gears to achieve the required different rotational speeds. The present invention is not limited in this regard as each of the rotor and casing portions can be driven by any known or conventional means.

In a further embodiment, only the rotor portion 50 is driven by a motor 58. In such an embodiment the rotor portion precesses as well as rotates. To accomplish this any known methodology or structure may be used, such as a cam structure, or the like.

Coupled to the upstream end 54 is an inlet plenum 53 which directs the medium or material to the upstream end 54. The configuration and design of the inlet plenum 53 is dictated by the operational and design parameters of the device 500 and the present invention is not limited in this regard. Similarly, in the embodiment shown in FIG. 5 an exhaust plenum 55 is coupled to the downstream end 56 into which the material or medium is flowed. Again, the present invention is not limited with regard to the configuration of the plenum 55, as its construction is a function of the operational and design parameters of the device 500.

Downstream of the plenum 55 is a device 60 which receives the material or medium that was flowed through the flow control device 50. There is no limitation as to what the device 60 may be. For example, in a pulse detonation combustor application, the device 60 may be the combustor portion of the PDC and an oxidizer or oxidizer-fuel mixture is flowed through the flow control device 50. In such an embodiment, the flow control device 50 blocks any backflow from the combustor of the PDC to any upstream components. In a further alternative embodiment, the device 60 may be a standard combustor for liquid fuel or coal, or simply may be a tank of some kind. Because the present invention provides 100% diodicity, the present invention may be employed in any situation, where it is desired to protect upstream components from downstream pressure increases or transients.

Figure 6:
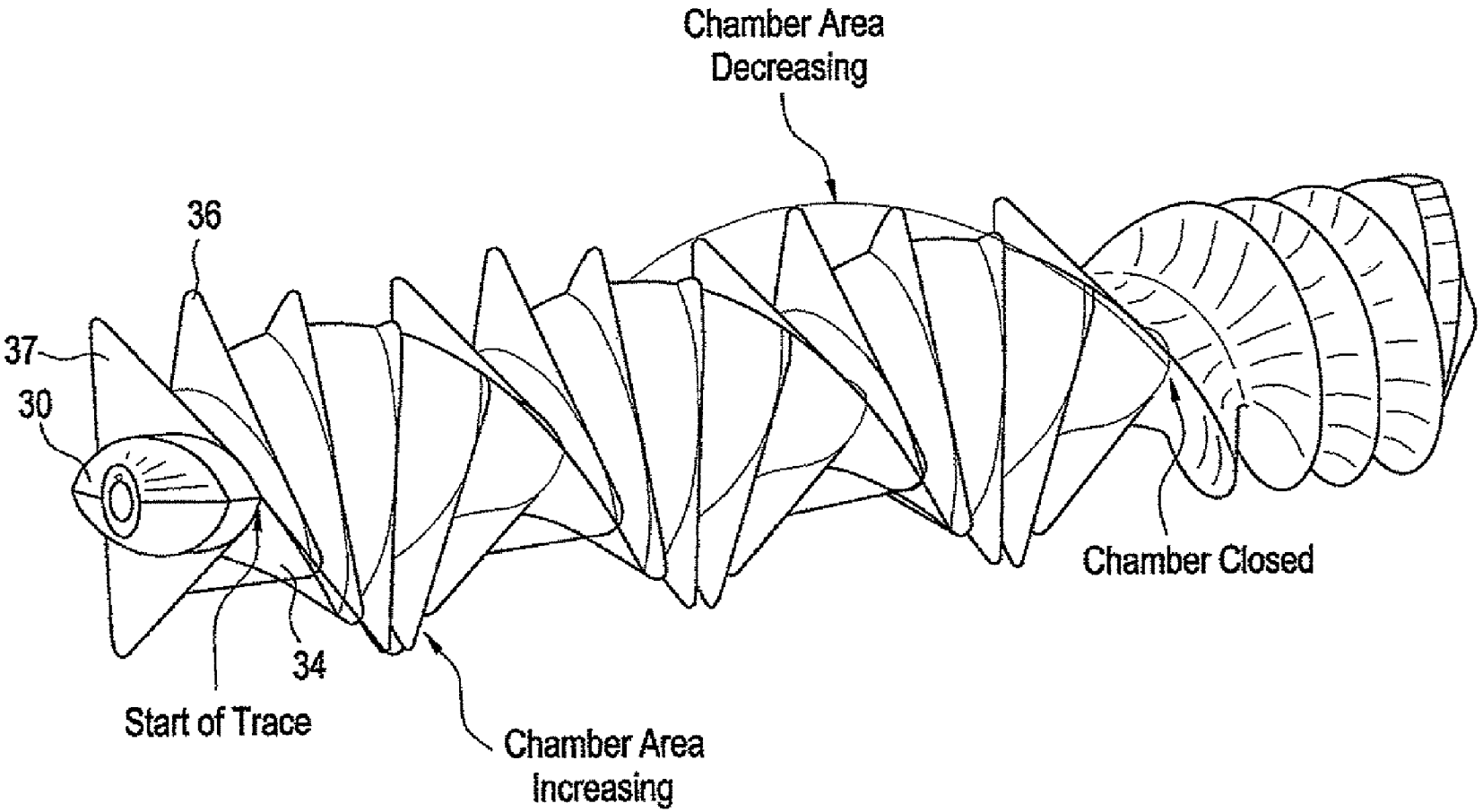
FIG. 6 is a diagrammatical representation of a fill trace of an exemplary embodiment of the present invention.

FIG. 6 depicts a simplified trace of the rotor portion 30 (from FIG. 3) and the area 37. As shown, the trace begins at the upstream end 38 of the rotor portion 30 and the volume closes at a point downstream. In fact, in the embodiment shown, the chamber (i.e. volume) closes after a single rotation of the rotor portion 30. Thus, the length of the flow control device must be such that at least one volume is captured. This ensures 100% diodicity.

For the purposes of calculating the volume created by the sum of the areas 37, the volume may be calculated by integrating the cross-sectional area 37 along the Z-axis (i.e. the length of the rotor portion 30).

Figure 9:
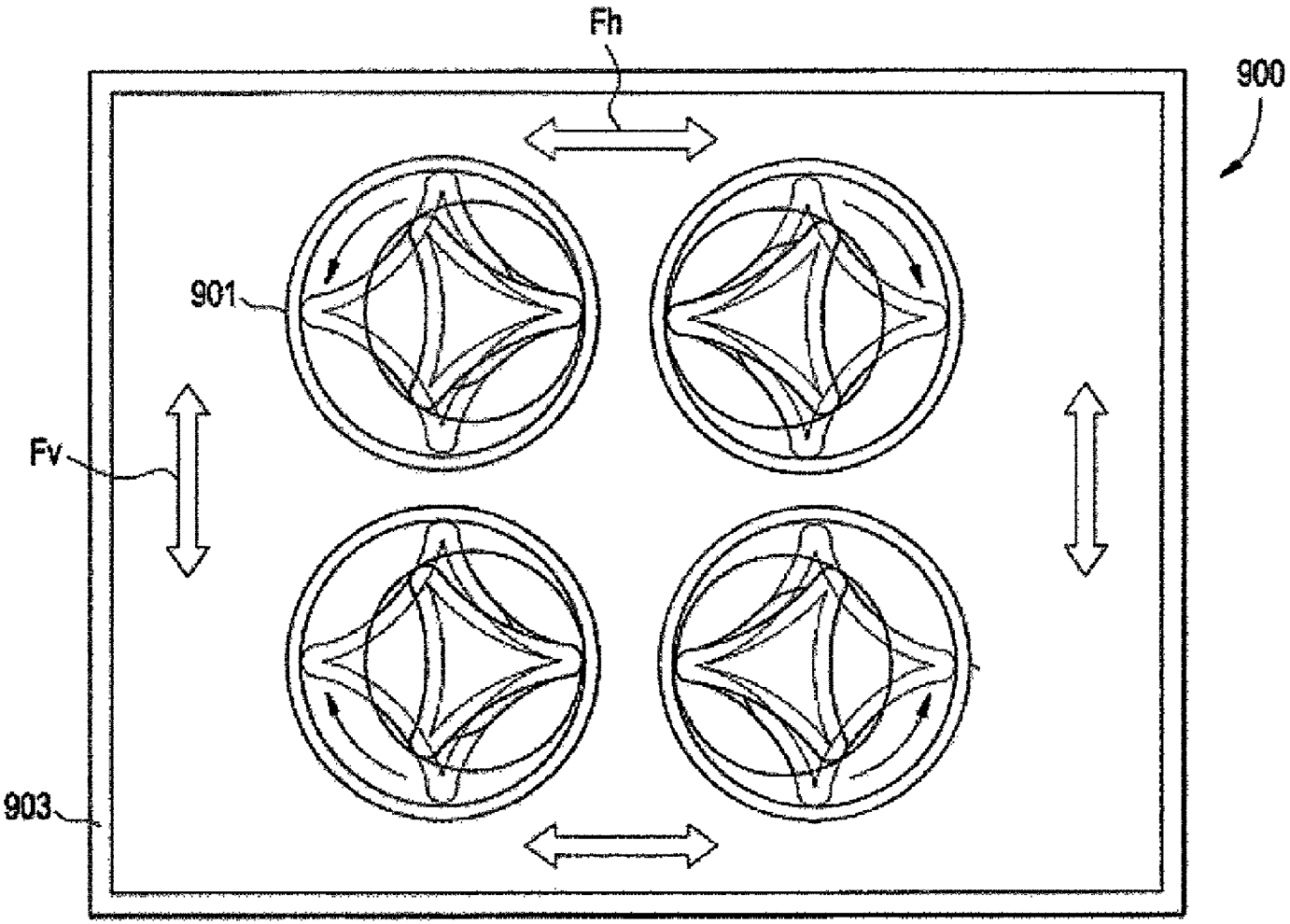
FIG. 9 is a diagrammatical representation of a plurality of positive displacement capture devices in accordance with an embodiment of the present invention in a balanced configuration.

FIG. 9 depicts an embodiment of the present invention where a plurality (four) PDCDs 901 are positioned and oriented in a balanced fashion. As discussed above, in one embodiment of the invention both the rotor and casing rotate and in another only the rotor rotates. In the embodiment where only the rotor rotates it also moves eccentrically to ensure that proper contact is made between the rotor and casing structures. During operation this eccentric movement of the rotor causes eccentric loads to be experienced by the device mounting structure. These eccentric loads would be transmitted through the mounting or support structure into surrounding components and thus increase the possibility of wear and damage or otherwise require additional support structure to address the additional eccentric loading. The additional support structure adds additional weight and expense to the overall application in which the device is used.

In FIG. 9, a PDCD stage or section 900 is shown with a plurality of devices 901 within a mounting structure 903. The PDCD stage or section 900 can be positioned or located in any apparatus, such as a power generation apparatus, aircraft engine, etc. in which the present invention can be utilized, In FIG. 9 the mounting structure 903, which is used to coupled the stage 900 to the remaining apparatus in which it is located, is depicted as a housing which surrounds the devices 901. However, the present invention is not limited in this regard and the mounting structure 903 is depicted representatively in this figure. The structure 903 can be any structure which secures each of the devices 901 to each other and to whatever overall device or component in which the devices 901 are to be employed, for example a power generation device or aircraft engine.

In an embodiment of the invention, the devices 901 are positioned adjacent to each other and oriented such that the eccentric loads created by each individual device 901 are balanced by the eccentric loads of adjacent devices 901. In such a configuration and orientation the eccentric loads created by the devices 901 are absorbed and balanced within the structure 903 and are not transmitted externally to the structure.

As shown in the exemplary embodiment of FIG. 9, there are four (4) devices 901 positioned in a square pattern. Further, the upper left and bottom right devices 901 are oriented such that the rotor rotates in a counter-clockwise direction. The upper right and bottom left devices 901 are oriented so that they rotate in a clockwise direction. Additionally, in this embodiment, the timing of the rotor rotation of the respective devices is such that equal and opposite eccentric loads are created by adjacent devices 901 at the same time.

For example, the devices 901 are oriented and operationally timed such that when the device 901 in the upper right of the figure is imparting a vertical eccentric force of −100 Newtons, the lower right device 901 is imparting a vertical eccentric force of +100 Newtons.

As shown, with this configuration, orientation and rotational timing the vertical eccentric forces Fv and the horizontal eccentric forces Fh created by the operation of the devices 901 are effectively cancelled out outside of the mounting structure 903. Therefore, it is not necessary design and account for eccentric loading outside of the mounting structure 903. Of course, whatever implementation of the present invention is employed must account for the weight of the mounting structure 903 and devices 901, and any longitudinal forces created by the operation of the devices 901.

Thus, it is contemplated that rather than using a single large device 901 of the present invention in an application, the single device can be replaced with a plurality of smaller devices 901 to provide the same flow as desired but without creating eccentric loading on the surrounding components of the overall application.

FIG. 9 shows a configuration where there are fours (4) devices 901 distributed in a square-type configuration. However, the present invention is not limited in this regard. Namely, it is contemplated that the devices 901 can be distributed in any geometric pattern which would allow for the eccentric forces to be accounted for within the mounting structure 903. Further, the present invention is not limited to a configuration using four (4) devices. It is contemplated that the overall number of devices 901 can be changed.

Further, although the embodiment shown in FIG. 9 shows a configuration in which both the vertical and horizontal eccentric forces are cancelled out, it is also contemplated that certain applications may only require one of the vertical or horizontal forces to be cancelled out. In such applications the number, orientation, distribution and rotational timing of the devices 901 is selected to effect the desired result. For example, in an embodiment in which only the vertical eccentric forces Fv are to be accounted for, two of the devices 901 can be positioned vertically with respect to each other.

In an alternative embodiment of the present invention, the eccentric loads experienced as a result of the rotor rotation are counteracted by a counterbalance. As shown in FIG. 5, a counterbalance 905 is mounted to the shaft of the rotor 50. The counterbalance 905 is of a weight and size to sufficiently counteract the eccentric loads created by the rotation of the rotor 50. The counterbalance 905 is shown secured to the shaft at an upstream location. However, the present invention is not limited in this regard as the counterbalance can be positioned at a downstream location with respect to the rotor 50. Further, the present invention is not limited to employing a single counterbalance 905 as shown. It is contemplated that, to reduce the size of the counterbalance 905, the counterbalance 905 can be broken up into two or more pieces placed at varying locations with respect to the rotor 50. Such a configuration eliminates the need for a single larger counterbalance 905 located on the rotor shaft.

Further, although FIG. 5 shows the counterbalance 905 secured to the shaft of the rotor 50, the present invention contemplates locating the counterbalance 905 at other locations which effectively counteracts the eccentric loads created during rotor rotation. One of ordinary skill in the art is capable of determining the overall weight and size of the counterbalance needed to offset the eccentric loads created during operation.

It is noted that although the present invention has been discussed above specifically with respect to aircraft applications, the present invention is not limited to this and can be employed in any application which experiences varying operational/performance conditions that require upstream components to be effectively isolated from downstream operations While the invention has been described in terms of various specific embodiments, those skilled in the art will recognize that the invention can be practiced with modification within the spirit and scope of the claims.

What is claimed is:

1. A positive displacement capture device; comprising:

a positive displacement capture stage comprising a plurality of positive displacement flow devices; each of said positive displacement flow devices comprising:

a casing portion having a plurality of grooves formed on an inner surface of said casing portion; and a rotor portion having a plurality of lobes formed on an outer surface of said rotor portion, where said rotor portion is positioned adjacent to said inner surface of said casing portion such that said lobes interact with said grooves;

wherein said interaction of said lobes with said grooves creates a plurality of contact points between said lobes and grooves which travel around a perimeter of, and along a length of, said rotor portion as said rotor portion rotates about an axis relative to said casing portion; and wherein said interaction captures a volume of material and moves said volume along a length of said positive displacement flow device due to said relative rotation, wherein the respective rotor portions of at least some of said positive displacement flow devices rotate in a clockwise fashion and wherein the respective rotor portions of the remaining positive displacement flow devices rotate in a counterclockwise fashion, and wherein each of said plurality of positive displacement flow devices is positioned and oriented within said positive displacement capture stage such that a first group of structural loads created by the rotation of one of said rotor portions of one of said positive displacement flow devices is counteracted by a second group of structural loads created by the rotation of at least one other of said rotor portions of the at least one other of said positive displacement flow devices.

2. The positive displacement capture device of claim 1, wherein each of said plurality of positive displacement flow devices is positioned and oriented within said positive displacement capture stage such that a third group of structural loads created by the rotation of one of said rotor portions of one of said positive displacement flow devices is counteracted by a fourth group of structural loads created by the rotation of at least one other of said rotor portions of the at least one other of said positive displacement flow devices.

3. The positive displacement capture device of claim 1, comprising four of said positive displacement flow devices.

4. The positive displacement capture device of claim 1, wherein each of said positive displacement flow devices is positioned within a mounting structure.

5. The positive displacement capture device of claim 1, wherein each of said positive displacement flow devices is positioned adjacent to each other.

6. The positive displacement capture device of claim 1, wherein said positive displacement flow devices are distributed in one of a rectangular or square orientation.

7. The positive displacement capture device of claim 1, wherein said first and second group of structural loads are either vertical or horizontal structural loads.

8. A positive displacement capture device; comprising:

a positive displacement capture stage comprising a plurality of positive displacement flow devices; each of said positive displacement flow devices comprising:

a casing portion having a plurality of grooves formed on an inner surface of said casing portion; and a rotor portion having a plurality of lobes formed on an outer surface of said rotor portion, where said rotor portion is positioned adjacent to said inner surface of said casing portion such that said lobes interact with said grooves;

wherein said interaction of said lobes with said grooves creates a plurality of contact points between said lobes and grooves which travel around a perimeter of, and along a length of, said rotor portion as said rotor portion rotates about an axis relative to said casing portion; and wherein said interaction captures a volume of material and moves said volume along a length of said positive displacement flow device due to said relative rotation, wherein the respective rotor portions of at least some of said positive displacement flow devices rotate in a clockwise fashion and wherein the respective rotor portions of the remaining positive displacement flow devices rotate in a counterclockwise fashion and wherein each of said plurality of positive displacement flow devices is positioned and oriented within said positive displacement capture stage such that a first group of structural loads created by the rotation of one of said rotor portions of one of said positive displacement flow devices is counteracted by a second group of structural loads created by the rotation of at least one other of said rotor portions of the at least one other of said positive displacement flow devices, and a third group of structural loads created by the rotation of any one of said rotor portions of one of said positive displacement flow devices is counteracted by a fourth group of structural loads created by the rotation of at least one other of said rotor portions of the at least one other of said positive displacement flow devices.

9. The positive displacement capture device of claim 8, comprising four of said positive displacement flow devices.

10. The positive displacement capture device of claim 8, wherein each of said positive displacement flow devices is positioned within a mounting structure.

11. The positive displacement capture device of claim 8, wherein each of said positive displacement flow devices is positioned adjacent to each other.

12. The positive displacement capture device of claim 8, wherein said positive displacement flow devices are distributed in one of a rectangular or square orientation.

13. The positive displacement capture device of claim 8, wherein said first and second group of structural loads are either vertical or horizontal structural loads.

* * * * *